US006526599B2

(12) United States Patent
Benayahoo

(10) Patent No.: US 6,526,599 B2
(45) Date of Patent: Mar. 4, 2003

(54) PASSIVE DISPENSER FORDOSING AND ISSUING A PREDETERMINED AMOUNT OF DISPENSABLE LIQUID

(76) Inventor: Levanon Benayahoo, Beitar Street 12, Rishon LeZion 75274 (IL)

( * ) Notice: Subject to any disclaimer, the term of this patent is extended or adjusted under 35 U.S.C. 154(b) by 0 days.

(21) Appl. No.: 09/910,512

(22) Filed: Jul. 19, 2001

(65) Prior Publication Data

US 2002/0074368 A1 Jun. 20, 2002

Related U.S. Application Data

(63) Continuation of application No. PCT/IL99/00616, filed on Nov. 21, 1999.

(51) Int. Cl.[7] ..... E03D 9/03
(52) U.S. Cl. ..... 4/227.7
(58) Field of Search ..... 4/227.4–227.7

(56) References Cited

U.S. PATENT DOCUMENTS

| | | | | |
|---|---|---|---|---|
| 1,144,525 A | * | 6/1915 | Blake | 4/227.7 X |
| 3,787,904 A | | 1/1974 | Lerner | |
| 3,806,965 A | | 4/1974 | Lerner | |
| 3,890,657 A | | 6/1975 | Gray | |
| 4,189,973 A | | 2/1980 | Williamson et al. | |
| 4,635,302 A | | 1/1987 | Dolan | |
| 4,915,260 A | | 4/1990 | Jones | |
| 5,042,095 A | | 8/1991 | Schope et al. | |

FOREIGN PATENT DOCUMENTS

| | | | |
|---|---|---|---|
| DE | 1609279 | | 4/1970 |
| DE | 3728126 | * | 3/1989 |
| GB | 1243039 | | 8/1971 |
| GB | 2065738 | * | 7/1981 |

* cited by examiner

*Primary Examiner*—Charles E. Phillips
(74) *Attorney, Agent, or Firm*—Shalom Wertsberger; Saltamar Innovations

(57) ABSTRACT

A dispenser for dispensing metered amount of liquid into a toilet cistern, comprising a basin adapted to receive a metered amount of dispensable liquid received from a container via a discharge spout. An airlock prevents further discharge of liquid above a predetermined amount in the basin when the discharge spout is covered by the dispensable liquid. A siphon inlet is in liquid communication with the metered amount in the basin, and the siphon outlet is in liquid communications with the cistern water at quiescent times. Upon flush, the siphon siphons out the dispensable liquid in the basin, breaking the airlock, and allowing a new metered amount of dispensable liquid to flow to the basin, ready for next flush.

28 Claims, 9 Drawing Sheets

PASSIVE DISPENSER FORDOSING AND ISSUING A PREDETERMINED AMOUNT OF DISPENSABLE LIQUID

This application is a continuation of PCT application number PCT/IL99/00616, filed Nov. 21, 1999 and published as WO01/38656 on May 31, 2001.

FIELD OF THE INVENTION

The present invention relates to methods and devices for releasing additives, such as disinfectants, cleaning agents, colorants, perfumes and the like into the toilet flush water, and in particular to those designed to locate within the cistern or a flush pipe of a toilet.

BACKGROUND OF THE INVENTION

The application of additives to water flushing toilet bowls serves numerous purposes, such as cleansing, avoiding deposit of sediments, disinfecting, perfuming and even coloring of the water for aesthetic purposes. The application of such additives has long been a problem of interest in the art. An example of the efforts to solve such problems is the use of a soluble solid cake holding the required additives. The cake is immersed in the water stored in the flush water tank or cistern that is conventionally attached to the toilet bowl. The cake gradually dissolves in the water and so the additives reach the toilet bowl with every flush of the water. However, the soluble materials of the cake dissolve at a constant rate, irrespective of the frequency of the flushing of water or the duration of quiescent periods, i.e. the periods between successive flushes. Thus, the dosage of metered amount of solid additives dissolving in the water of the cistern is either impossible or requires awkward solutions. Other attempts in the prior art involve the use of liquid additives. Liquids may be rationed more easily into the water, by their manipulation within chambers, from which they are released, with the aid of means such as siphons, conduits, buoys, valves, dilution chambers and so forth. However, the viscosity of the liquid additives poses a major obstacle. Highly viscous liquids tend to clog water passages and deposit layers that cling to valves and buoys and the like and so obstruct their functioning. Low viscosity of liquids reduces dramatically the possible concentration of the additives and results with inefficient use thereof, as well as requires very large containers for the liquids. No wonder, that the user is seldom given with the capability to adjust his desired amount of additives rationed.

There is thus a widely recognized need for, and it would be highly advantageous to have an in-tank dispensing device for dosing a toilet liquid additive, free of clogging problems, provides for the use of highly viscous liquid additives and that provides for user adjustable dosage capabilities.

It is therefore an object of this invention to provide an in-tank dispensing device for dosing a toilet liquid additive without the disadvantages entailed with the prior art.

Further objects of this invention are to provide an in-tank dispensing device for dosing a toilet liquid additive whereby the device efficiently releases rationed amounts of liquid additives into the water stored in the toilet system in each flushing cycle, irrespective of the duration of quiescent periods between flushing cycles, durable, easy to manufacture, requires mere hanging on the spot by unskilled personnel, adapted to couple to conventional toilet cisterns, allows the use of refillable container or replacement of disposable refills or provides for an entirely disposable device.

These and other objects will become more apparent when viewed in light of the accompanying drawings and following detailed description.

SUMMARY OF THE INVENTION

In its broadest aspects the present invention comprises an in-tank passive dispenser for dosing and issuing a predetermined amount of a relatively viscous, moderately soluble, having specific density heavier than water, dispensable liquid, into the cistern tank and the bowl of a flushable toilet as the flush water is draining therefrom with each flush cycle of the toilet.

The dispenser is capable of varying the amount of dispensable liquid added to the toilet flush water, wherein the dispensable liquid contains additives to the flush water such as a disinfectant, a detergent, a cleaner, a stain inhibitor, a bleach, a dye, a colorant, a fragrance, a perfume, a deodorant or a compatible mixture of two or more thereof.

The dispenser comprises an inverted container in which a volume of dispensable liquid is stored, the container comprises a downwardly directed discharge spout positioned on the container below the dispensable liquid level within the container and below the water level in the tank during quiescent periods intermediate flush cycles, the dispensable liquid in the container is maintained in an isolated condition from the cistern water surrounding the dispenser regardless of the depth to which the dispenser is immersed in the cistern water by the airlock created.

The dispenser also features hanger means adapted to suspend the dispenser in the cistern water from an upper portion of the cistern and enabling adjustability of the position or level of the container in the cistern, preferably comprising an elongated portion having at an upper end, means to attach to an upper edge of a cistern side wall, the elongated portion being dimensioned to co-operate with a connection means on the dispenser, in a manner so as to permit the dispenser to be adjustable therealong.

The hanger means may optionally comprise an elongated flat bar horizontally and removably attached to the inverted container and having a bent down portion at a first end adapted to attach to an upper edge of a cistern wall. The flat bar comprises a groove cut therealong, and the container comprises an upward projecting clasp located a the upper portion of the container, adjacent the cistern wall. The clasp comprises an Elongated portion adapted to be guided along the groove. The elongated portion comprises upper side flanges extending beyond the width of the groove for clinging the flat bar to the top of the container when the elongated portion is inserted in the groove. The the groove comprises a broadened aperture at the second end of the bar, through which aperture the clasp may be removably inserted.

Further optionally, the hanger means may comprise a curving bar adapted for its affixing to the cistern wall, wherein the bar comprises a central portion curving toward the container, the central portion comprises a vertical slit open at its top and closed at its bottom, the container comprises a clasp projecting toward the cistern wall adjacent the top of the container, the clasp comprises an elongate portion adapted to be guided along the slit, and the elongate portion comprises external side flanges extending beyond the width of the slit for clinging the bar to the container when the elongated portion is inserted in the slit.

The clasp may be mounted on a depressed section of the container wall for ensuring that the clasp does not protrude beyond the level of the other non-depressed section of the same container wall.

Preferably, the inverted container comprises a substantially flat wall adapted to facilitate adjacent positioning against the cistern wall when the container is placed in the cistern.

The dispenser further comprises a basin located below the discharge spout for receiving the predetermined amount of dispensable liquid from the container, the basin comprises basin attaching means for affixing the basin to the container wherein the discharge spout mouth is adjacently disposed above the basin floor, the basin floor is disposed above the water level of the cistern when the cistern is emptied during the flush cycle, upstanding basin side walls extending upwards above the dispensable liquid level of the predetermined amount of dispensable liquid (alternatively referred to as 'metered amount'), and below the water level in the tank during quiescent periods, so that cistern water fill the basin above the predetermined amount of dispensable liquid during quiescent periods, and a siphon in the form of an inverted U-shaped conduit having a short stand pipe joined by a U shaped bend—extending above the level of the predetermined amount of dispensable liquid in the basin but below the water level during quiescent periods, to a long standpipe, the inlet mouth of the siphon is disposed at the lower end of the short standpipe and being immersed in the predetermined amount of dispensable liquid contained in the basin, and in fluid communication therewith, and the outlet mouth of the siphon is disposed at the lower end of the long standpipe below the bottom of the basin in fluid communication with the cistern water.

The basin may also comprise discharge control means that provide for a restrained discharge of disposable liquid from the discharge spout, preferably the discharge spout comprises an externally threaded end compatibly receivable by rotary movement relative to, and within an internally threaded upstanding sleeve attached to the basin and encircling the threaded end, the sleeve comprises at least one aperture or cut-out area, the extent of exposure of which is defined by the vertical adjustment of the threaded end within the sleeve, and a surface tension moderator in the form of ribs mounted in the mouth of the discharge spout or in the form of an upright projecting from the basin floor and overlappingly penetrating the mouth of the discharge spout.

Thus, on intake of flush, water and/or dispensable liquid is siphoned out of the siphon as the cistern flush water drops below the siphon outlet mouth so that the emptied siphon draws dispensable liquid from the basin, a further amount of dispensable liquid enters the basin as air penetrates said container via said discharge spout, until the water level in the cistern rises to its level during quiescent periods. Thus, the cyclic rise and fall of the cistern water results in the controlled discharge—by a siphoning action, of a rationed amount of dispensable liquid from the container.

Further features and advantages of the invention will be apparent from the description below, given by way of example only.

BRIEF DESCRIPTION OF THE DRAWINGS

The present invention will be further understood and appreciated from the following detailed description, taken in conjunction with the following enclosed drawings in which like numerals designate correspondingly analogous elements or sections throughout, and in which:

FIG. 18*a* is a top perspective view, and FIG. 18*b* is bottom perspective view of a top portion, cooperating with a bottom portion shown in top view in FIG. 19*a* and in a cutout side view in FIG. 19*b*.

DESCRIPTION OF THE PREFERRED EMBODIMENTS

Figure 1:
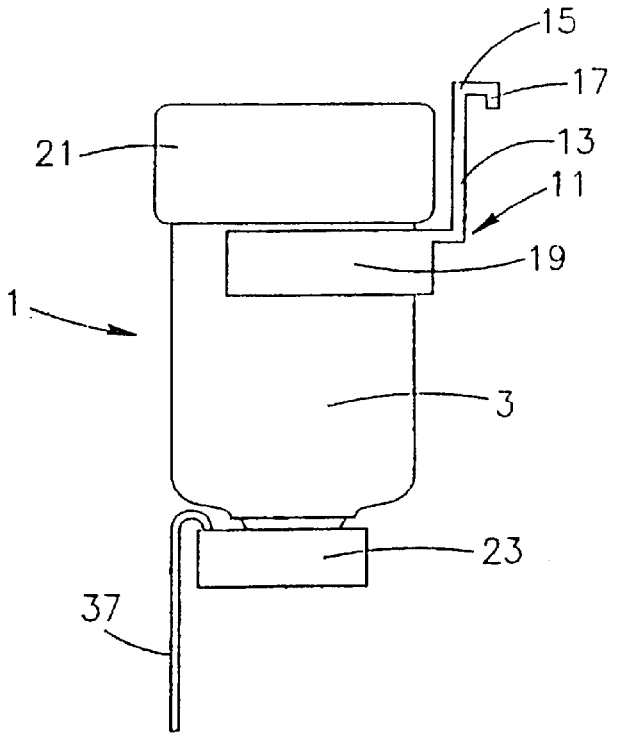
FIG. 1 is a schematic side cross sectional view of one preferable embodiment constructed and operative according to the invention.
Figure 2:
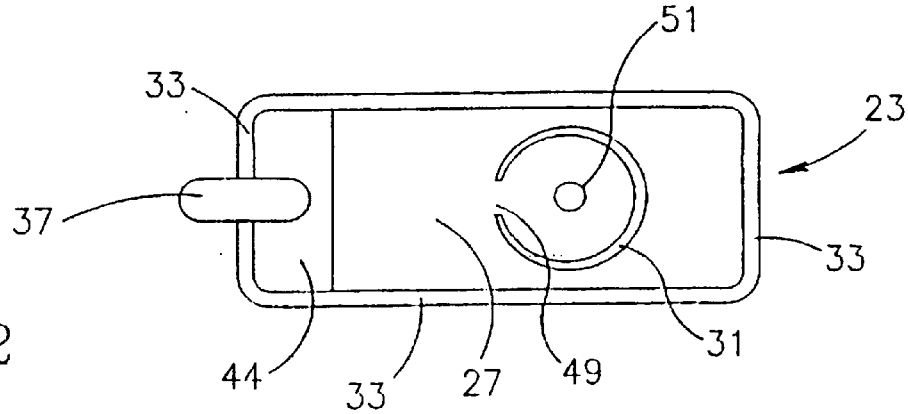
FIG. 2 is a top view of a dosage basin of the embodiment shown in FIG. 1.
Figure 3:
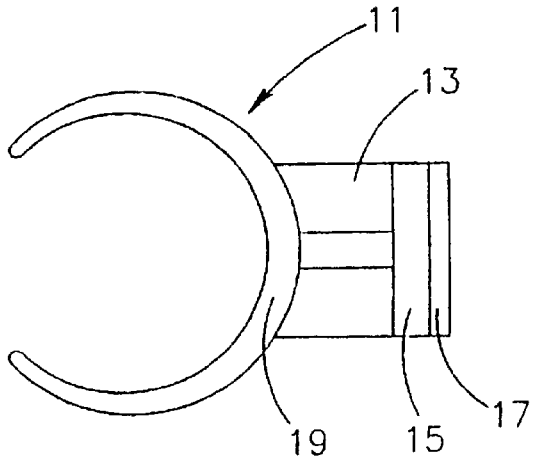
FIG. 3 is a bottom view of an attaching means to the toilet cistern wall, of the embodiment shown in FIG. 1.
Figure 4:
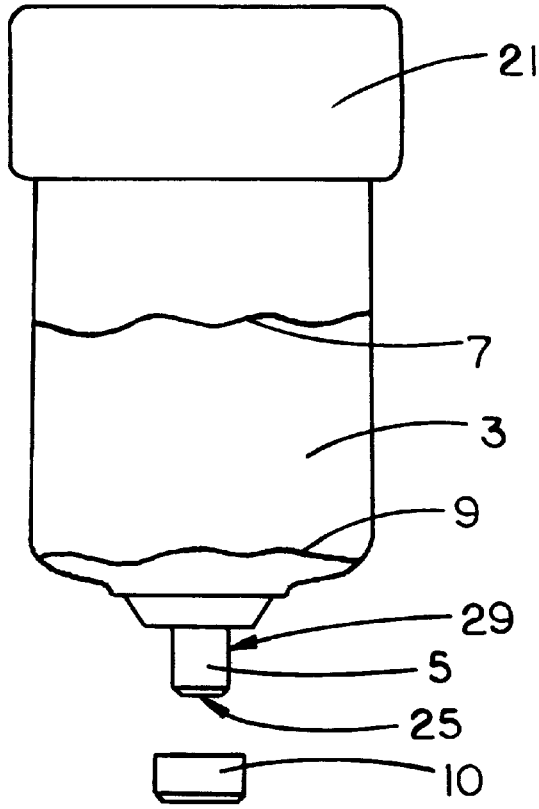
FIG. 4 is a side view of a liquid container of embodiment shown in FIG. 1.
Figure 5:
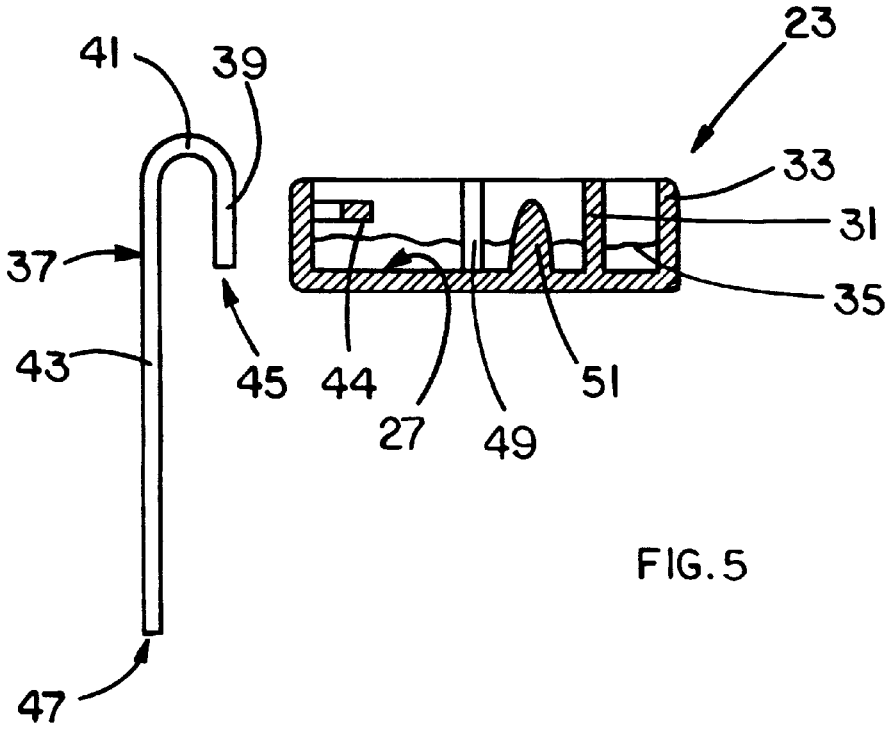
FIG. 5 is a cross sectional side view of the dosage basin of FIG. 2.
Figure 6:
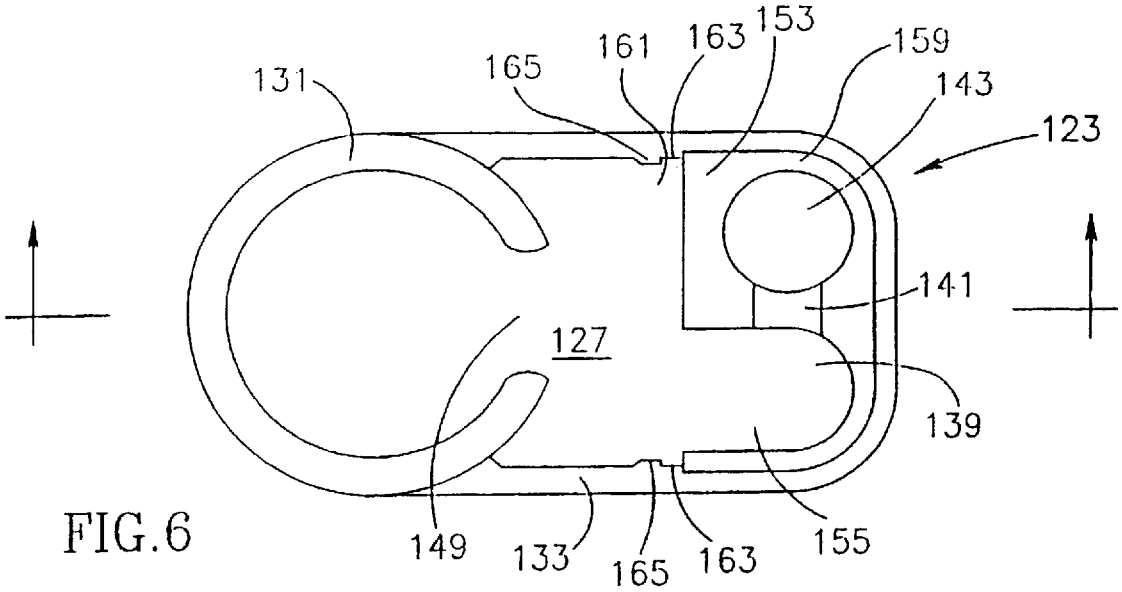
FIG. 6 is a cross sectional top view of a dosage basin of another preferable embodiment constructed and operative according to the invention.
Figure 7:
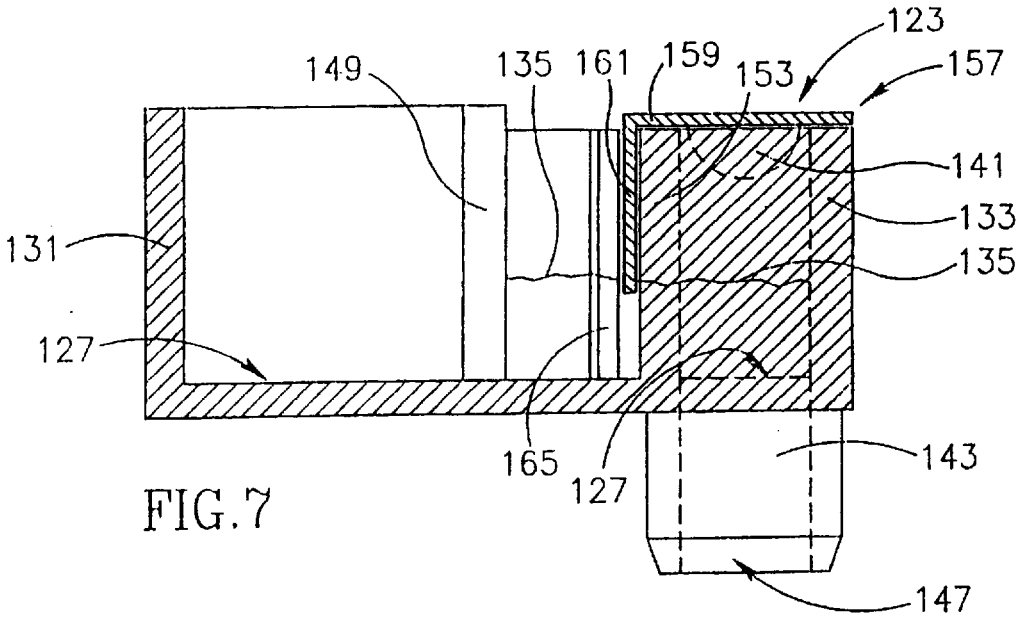
FIG. 7 is a cross sectional detailed side view of the embodiment of FIG. 6.
Figure 8A:
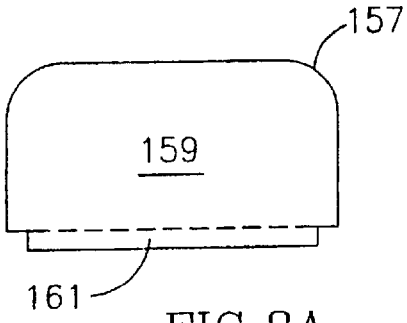
FIGS. 8*a* and 8*b* are top view and side view, respectively, of an enclosure cap of the dosage basin of FIG. 6.
Figure 8B:
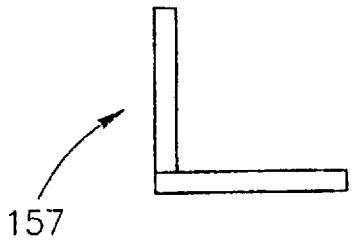

In general, the present invention is of an in-tank passive dispenser for dosing and issuing a predetermined amount of a dispensable liquid. The term "in-tank" refers to devices that are designed to locate in the cistern tank. By the term "dispensable" reference is made to the dispensing capability of the liquid with the flush water, namely, its being soluble within water, whether as a solution or in an emulsified manner. "Dispensable" also refers to the possibility of refilling the dispenser with fresh supply of liquid, or the disposable nature of the dispenser or a container thereof that holds the liquid.

The dispensable liquid is preferably relatively viscous—as characterizes a concentrated liquid for adequate effectiveness of a small amount. The dispensable liquid contains additives to the flush water such as a disinfectant, a detergent, a cleaner, a stain inhibitor, a bleach, a dye, a colorant, a fragrance, a perfume, a deodorant or a compatible mixture of two or more thereof. Preferably, the dispensable liquid is only moderately soluble and having a specific density heavier than that of water, for allowing its manipulation in the manner described below. Such requirements are not difficult to meet as most such liquids already inherently acquire the required qualities.

The dispenser is designed for dosing and issuing a predetermined amount of a dispensable liquid into the cistern tank and the bowl of a flushable toilet as the flush water is draining therefrom with each flush cycle of the toilet. As will be apparent from the following description the dispenser is capable of varying the amount of dispensable liquid added to the toilet flush water.

Reference is now made to FIGS. 1 to 5 in which a first embodiment of the invention is illustrated, with particular reference to a second embodiment of FIGS. 6 to 8*b*, in describing the differences with respect to the first embodiment.

Dispenser 1 comprises an inverted container 3 in which a volume of dispensable liquid is stored. Container 3 comprises a downwardly directed discharge spout 5 positioned on container 3 below the dispensable liquid level, such as illustrated by level 7, within container 3—which may vary from the top to the bottom of container 3 as more liquid is consumed therefrom. Discharge spout 5 must also be located below the water level in the tank during quiescent periods intermediate flush cycles, such as represented by level 9—which may vary from well over the top to the bottom of container 3, depending on its position within the cistern. The dispensable liquid in container 3 is maintained in an isolated condition from the cistern water surrounding the dispenser, regardless of the depth to which the dispenser is immersed in the cistern water by the airlock created. As will be appreciated by those skilled in the art, the air above level 7 prevents gravitational flow of the dispensable liquid from container 3, as long as discharge spout 5 is immersed in water and thus prevents penetration of air into container 3. Container 3 may be either refillable when emptied, or be disposable and replaceable by a full container—with or without the other parts that form dispenser 1. Plug 10 is therefore an optional feature that seals container 3, and is removed prior to the attachment of container 3 to the other parts of dispenser 1.

Dispenser 1 further comprises hanger means 11 adapted to suspend dispenser 1 in the cistern water from an upper portion of the cistern and preferably enabling adjusting the position or level of container 3 in the cistern. Hanger means 11 preferably comprises an elongated portion 13 having at an upper end 15 that comprises means to attach to an upper edge of a cistern side wall such as a hook or a bent edge 17. Elongated portion 13 is dimensioned to co-operate with a connection means on the dispenser, such as open ring 19 in a manner so as to permit dispenser 1 to be adjustable therealong. Such manner may be easily achieved, for example, by a friction tight or a snap-fit engagement between ring 19 and container 3. An optional broadened portion 21 of container may also serve as a stop means for preventing excessive sliding of container 3 from ring 19.

Dispenser 1 also comprises a deck or basin 23 located below discharge spout 5 for receiving a predetermined amount of dispensable liquid from container 3. Basin 23 comprises basin attaching means for affixing basin 23 to container 3, wherein discharge spout mouth 25 is adjacently disposed above the basin floor 27. Basin floor 27 is disposed above the water level of the cistern when the cistern is emptied during the flush cycle. Preferably, discharge spout 5 comprises an externally threaded end 29 compatibly receivable by rotary movement relative to, and within an internally threaded upstanding sleeve 31 attached to basin 23 and encircling threaded end 29. In order to provide for fine tuning capabilities of the amount of liquid discharged each flush cycle, threaded end 29 and sleeve 31 preferably comprise, in registration, relatively fine threading - allowing fine adjustment of threaded end 29 within sleeve 31.

For those skilled in the art wishing to implement the invention, it was found that the following dimensions of discharge spout 5 provide for excellent performance: height—7 mm; internal diameter—8 mm; diameter of its external threaded end—7/16".

Basin 23 further comprises upstanding basin side walls 33 extending upwards above the dispensable liquid level 35 of the predetermined amount of dispensable liquid, and below the water level in the tank during quiescent periods, so that cistern water fill the basin above level 35 of the predetermined amount of dispensable liquid during quiescent periods. Since the dispensable liquid is relatively viscous, moderately soluble, and having specific density heavier than water it will remain as a lower layer in the bottom of basin 23, with negligible amounts mixing in the surrounding water.

It will be appreciated by those skilled in the art that as long as discharge spout mouth 25 is immersed in dispensable liquid in basin 35, and as long as the dispensable liquid in basin 35 can not escape from basin 35, no further liquid will evacuate from container 3; The forces of the water column above level 35 during quiescent periods, the atmospheric pressure above the water and within sealed container 3 (approximately) and the qualities of the dispensable liquid, namely - being relatively viscous, moderately soluble, and having specific density heavier than water, and the relatively narrow passage via discharge spout 25 and the gap to basin 23, overcome the gravitational force that draws down dispensable liquid from container 3; The latter can provide for the drawing only during such time when such counter forces are temporarily nullified, as is achieved by the processes described below.

Basin 23 further comprises a siphon 37 in the form of an inverted U-shaped conduit having a short stand pipe 39 joined by a U shaped bend 41 extending above metered amount of dispensable liquid level 35 but below the water level 9 during quiescent periods, to a long standpipe 41. The inlet mouth 45 of siphon 37 is disposed at the lower end of short standpipe 39 and being immersed in the predetermined amount of dispensable liquid contained in the basin floor (below level 35) and in fluid communication therewith. The outlet mouth 47 of siphon 37 is disposed at the lower end of long standpipe 43 below the bottom 27 of basin 23 in fluid communication with the cistern water. The affixing of siphon 37 to basin 23 may be achieved by means such as clasp 44. On intake of flush, the cistern empties rapidly, and water and/or dispensable liquid that is within siphon 37 is siphoned out of the siphon as the cistern flush water drops below the siphon outlet mouth. Thence, the pressure within emptied siphon 37 drops dramatically and thus siphon 37 draws dispensable liquid from basin 23, in the amount predetermined according to the structure and size of siphon 37 or the amount present in basin 23, as well as the small amount of water still in the basin 23. Once the basin is emptied, air can freely penetrated into container 3 via discharge spout 5 and further dispensable liquid will flow into basin 23, until the flush cycle is over and the water level therein rises again to flood basin 23. It will be appreciated that the cyclic rise and fall of the cistern water thus results in the controlled discharge—by a siphoning action, of a rationed amount of dispensable liquid from container 3.

Preferably, basin 23 further comprises discharge control means that provide for a restrained discharge of disposable liquid from discharge spout 5. Such control means preferably may use an externally threaded end 29 of discharge spout 5 that is compatibly receivable by rotary movement relative to, and within an internally threaded upstanding sleeve 31 that is attached to basin 23 and encircles threaded end 29, as already explained above. Sleeve 31 preferably comprises at least one aperture or cut-out area 49, the extent of exposure of which is defined by the vertical adjustment of threaded end 29 within sleeve 31.

Due to excessive viscosity the smooth streaming of dispensable liquid through discharge spout 5 and area 49 may be hampered. An optional surface tension moderator in the form of an upright 51 that projects from basin floor 27 and overlappingly penetrates the mouth 25 of discharge spout 5 can relieve such hindrance.

Figure 9:
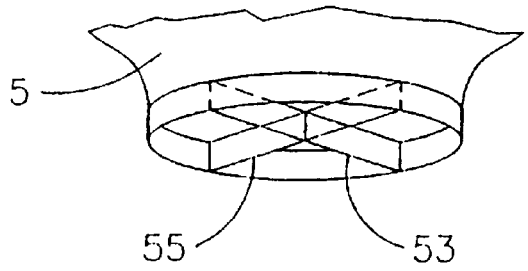
FIG. 9 illustrates an optional surface tension moderator that may be used in conjunction with a liquid container constructed and operative in accordance with the invention.
Figure 10:
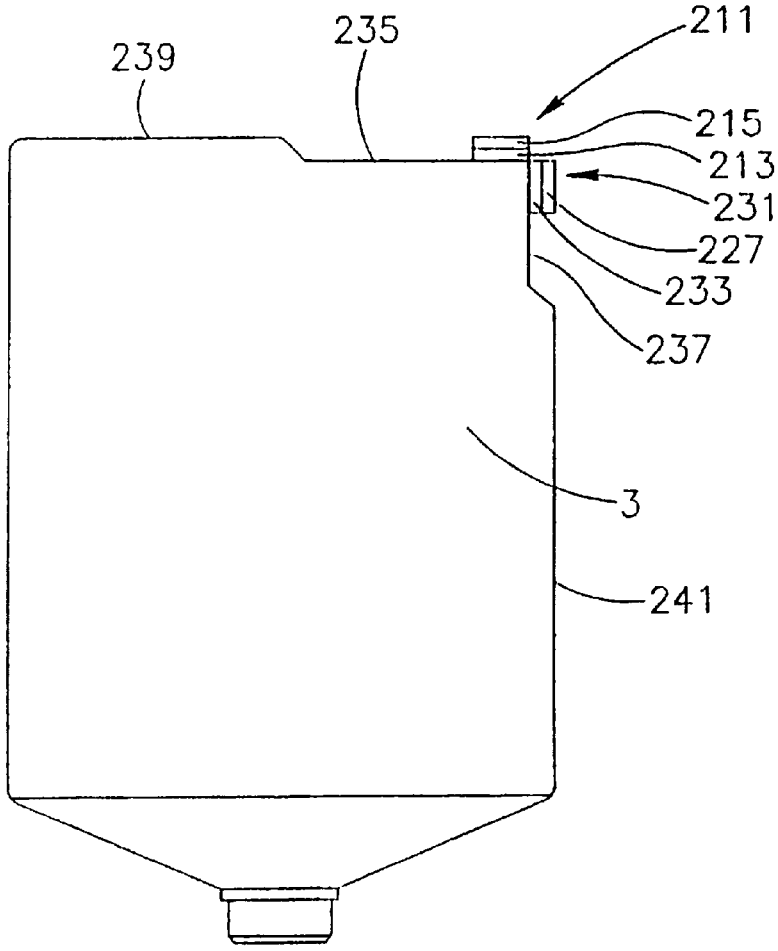
FIG. 10 is a side view of a liquid container of a further preferable embodiment constructed and operative according to the invention.
Figure 11:
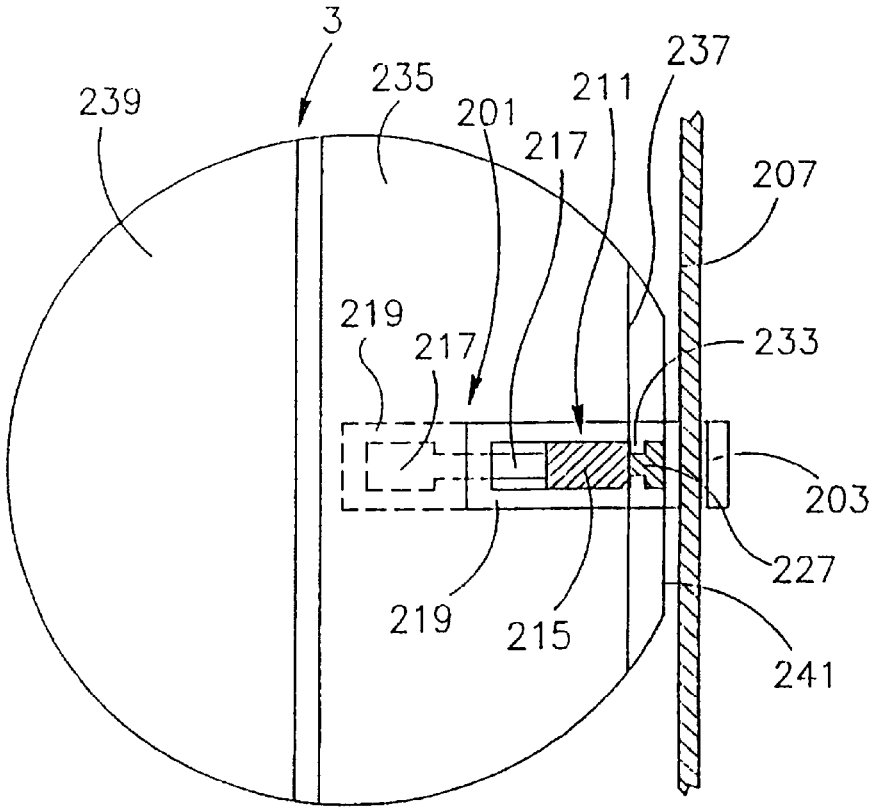
FIG. 11 is a top view of the liquid container of FIG. 10.
Figure 12:
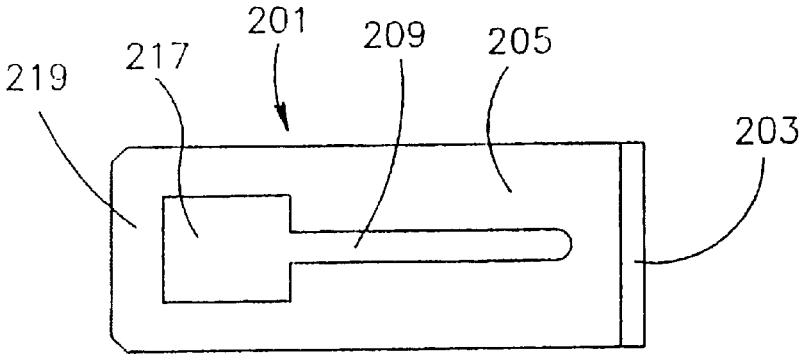
FIG. 12 is a top view of one preferable embodiment of hanger means that may be used in conjunction with the liquid container of FIG. 10.
Figure 13:
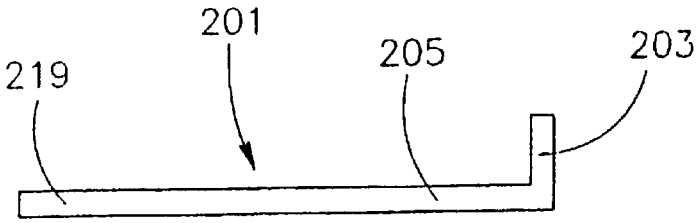
FIG. 13 is a side view of the hanging means of FIG. 12.
Figure 14:
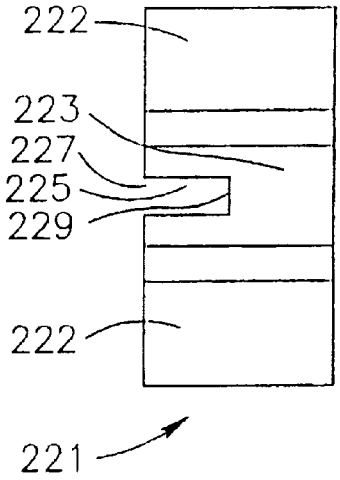
FIG. 14 is a side view of another preferable embodiment of hanger means that may be used in conjunction with the liquid container of FIG. 10.
Figure 15:
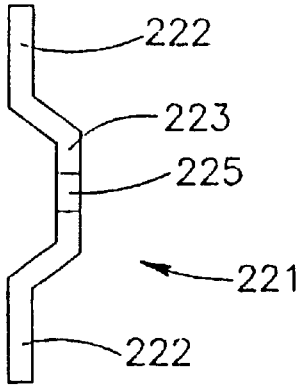
FIG. 15 is a top view of the hanging means of FIG. 14.
Figure 16:
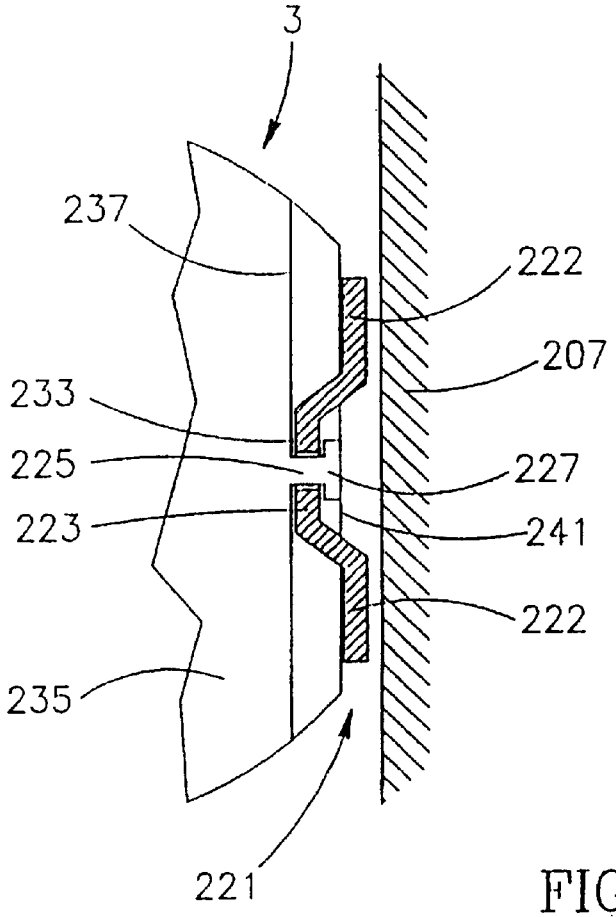
FIG. 16 is a partial top view of the liquid container of FIG. 10 assembled with the hanging means of FIG. 14.

Another example of surface tension moderator may be in the form of ribs mounted on the mouth of discharge spout 5, such as ribs 53 illustrated in FIG. 9. Ribs 53 preferably comprise upper sharp edges 55 for facing the dispensable liquid when incoming from container 3. Sharp edges enhance the tension moderating character of the ribs. Ribs 53 may be in the form of a cross shaped moderator, as in FIG. 9, but it will be appreciated that many variations of such form may be well suited for this function.

Referring now to FIGS. 6 to 8*b*, another embodiment of the present invention is shown. This embodiment is a compact, easy to manufacture, variation of the embodiment of FIGS. 1 to 5. Discharge spout 5 is inserted in a similar manner into ring 131 that features an opening 149 through which dispensable liquid flows on basin floor 127 of basin 123. Basin 123 comprises two conduits—a short conduit 139 with a closed bottom, and a long conduit 143 extending through basin floor 127 and having its outlet mouth 147 below basin floor 127. Conduits 139 and 143 may be drilled in a solid portion of basin 123 for ease of manufacture. An upper passage 141 connects the upper portions of conduits 139 and 143. A passage 155 connects the inner hollow parts of basin 123 to conduit 139. An enclosure and sealing element 157 completes the structure of basin 123. Element 157 has an L-shaped cross-section and comprises a roofing portion 159 and a side potion 161. Portion 159 conceals, in a substantially water tight manner the upper portion of chunk 153 and thus forms an upper roof to passages 141 and 155, and conduits 139 and 143. Portion 161 partially covers passage 155, but its main function is to hold portion 159 in place. Element 157 is disposed in place by inserting portion 161 through guiding rails 163 that are carved on walls 133 between chunk 153 and projections 165.

Reference is now made to FIGS. 10 to 16 in which further alternate embodiments of container 3 and hanger means are presented. Hanger means in FIGS. 10–13 comprise an elongated flat bar 201 removably horizontally attachable to inverted container 3 and having a downward bent portion 203 at its first end 205, adapted to attach to an upper edge 207 of a cistern wall. Flat bar 201 comprises a groove 209 cut therealong. Container 3 comprises a clasp 211 projecting upwards on the top portion of the container, adjacent the cistern wall 207. Clasp 211 comprises an elongate portion 213 adapted to be guided along groove 209. Elongated portion 213 comprises upper side flanges 215 extending beyond the width of groove 209 for clinging flat bar 201 to the top of container 3 when elongated portion 213 is inserted in groove 209. Groove 209 comprises a broadened aperture 217 at the second end 219 of bar 201, through which aperture 217 clasp 211 may be removably inserted. Bar 201 may be adjusted along elongated portion 213 in a friction tight manner to firmly grip cistern wall 207, and released whenever removal of container 3 is desired.

A further alternate embodiment of hanger means 11 is shown in FIGS. 10 to 11 and 14 to 16. Hanger means 11 further comprise a curving bar 221 adapted to be fixed to cistern wall 207, by any known manner, such as by the permanent bonding, riveting or fastening of lateral ears 222 to the cistern wall 207. Bar 221 comprises a central portion 223 curving toward container 3, and central portion 223 comprises a vertical slit 225 open at the top 227 and closed at the bottom 229. Container 3 comprises a clasp 231 projecting toward cistern wall 207 adjacent the top of container 3. Clasp 231 comprises an elongated portion 233 adapted to be guided along slit 225. Elongated Portion 233 comprises external side flanges 227 extending beyond the width of slit 225 in curving bar 221 to support container 3 when elongated portion 233 is inserted in slit 225.

Preferably, clasps 211 or 231 are mounted on a depressed section 235 or 237, correspondingly, of the wall of container 3 to ensure that clasp 211 or 231 does not protrude beyond the level of the other non-depressed section 239 or 241, correspondingly, of the same wall of container 3. Such configuration ensures that clasps 211 and 231 do not interfere with the contiguous attachment of container 3 to cistern wall 207 or its juxtaposing to upper cover of the cistern (not shown). Container 3 further preferably comprises a substantially flat wall 241 adapted to be contiguously positioned against cistern wall 207 when container 3 is placed the cistern, to eliminate movement and to stabilize container 3 while the cistern water turmoil.

Figure 17A:
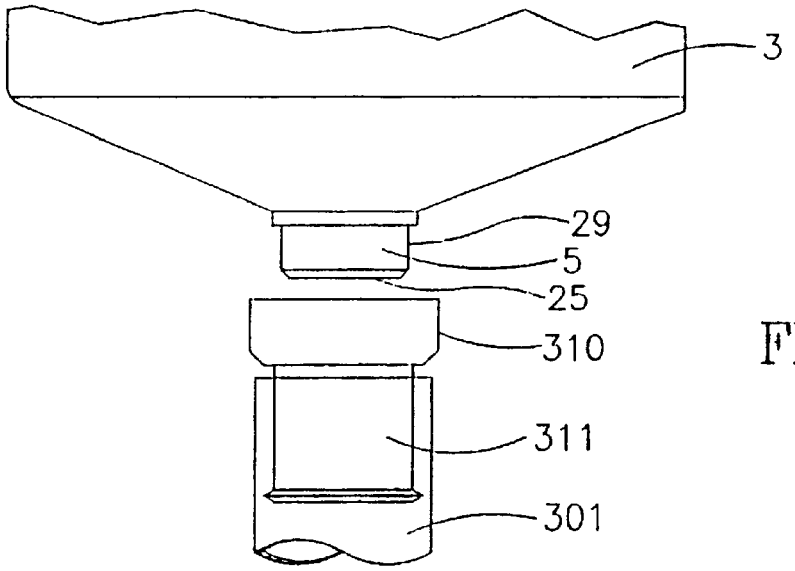
FIGS. 17*a*–17*c* illustrate, in registration, a side view of a liquid container, a partially cross-sectional side view of a dosage basin, and a top cross-sectional view of the same dosage basin, of a further preferable embodiment constructed and operative according to the invention.
Figure 17B:
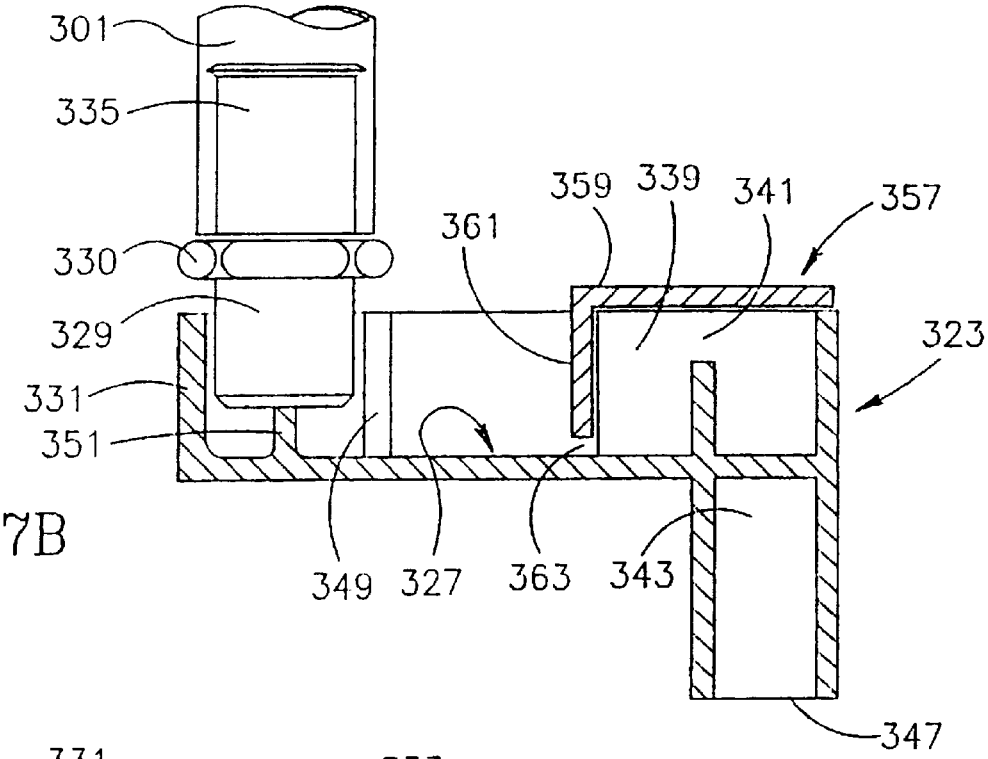
Figure 17C:
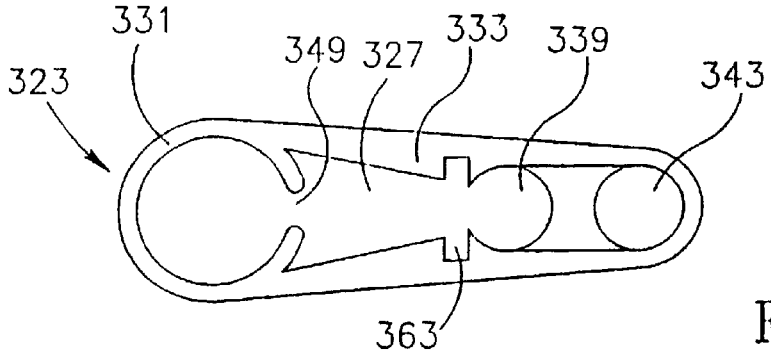
Figure 18A:
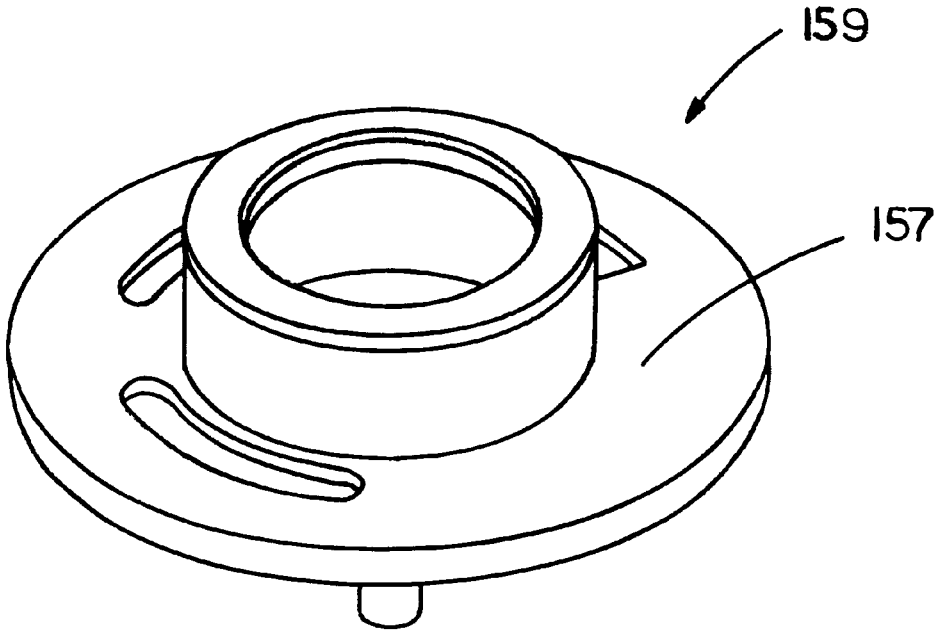
FIGS. 18*a*–18*b*, 19*a*–19*b* depicts different views of portions of the preferred embodiment of the invention, better suited for production, but operating according to similar principles.
Figure 18B:
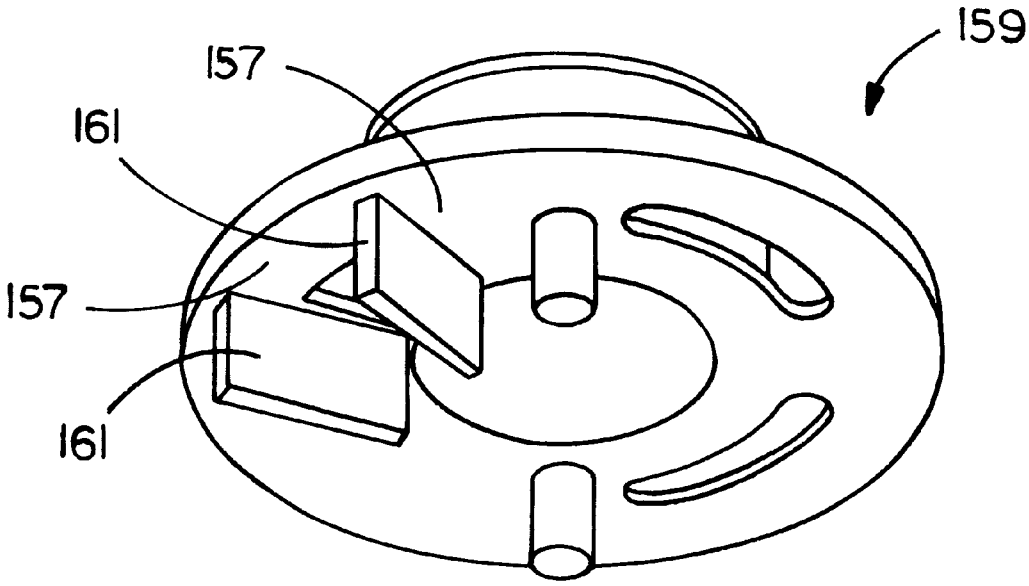
Figure 19A:
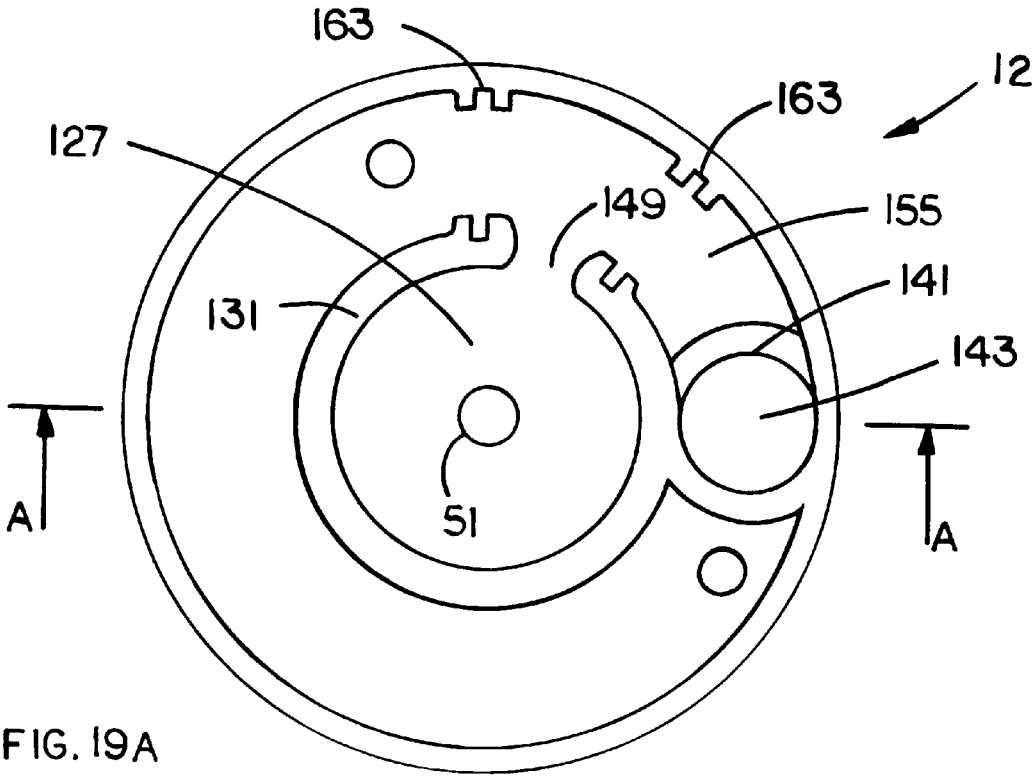
Figure 19B:
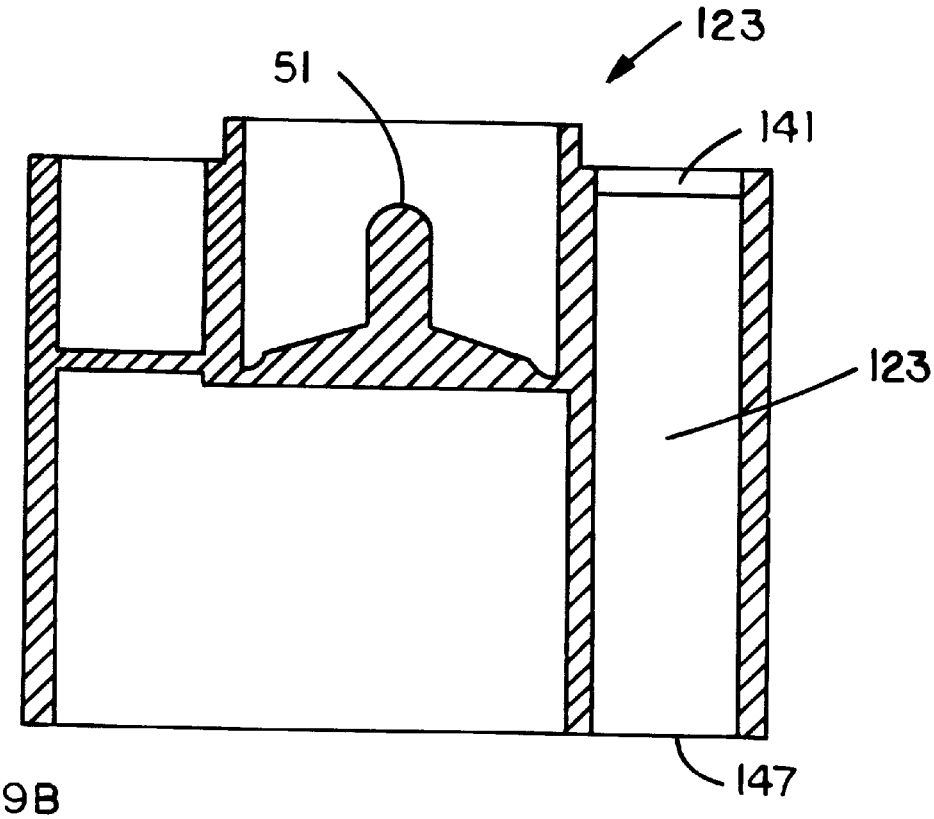

In reference to FIGS. 17*a* to 17*c*, a further embodiment of the present invention is shown. This embodiment is a further variation of the embodiment of FIGS. 1 to 5 and is particularly similar to that shown in FIGS. 6 to 8*b*. The main difference being in the addition of an intermediate conduit, such as a flexible plastic pipe 301, between liquid container 3 and basin 323. The addition of pipe 301 allows the mounting of liquid container 3 remotely from basin 323. The separation between container 3 and basin 323 provides, among others, for positioning container 3 outside the cistern. This configuration saves the need to hang dispenser 1 in its entirety within the cistern. Some flushing tanks may pose a difficulty for the insertion, placing or hanging of container 3 there within. This is the case when there is lack of sufficient clearance from the flushing mechanism inside the tank or when opening and closing of the tank-cover is inconvenient. Moreover, basin 323 may be made small enough to permit installation in the flushing conduits rather than in the tank itself. In such a case the specific weight or density of the dispensing liquid need not be heavier than that of water.

Discharge spout 5 is inserted in a similar manner into adapter ring 310 that features an extended conduit 311 that can be water-tightly inserted into the end of pipe 301. The other end of pipe 301 is similarly tightened to an extended conduit 335 of ring 330 that is in fluid communication with opening 349, through which dispensable liquid flows on basin floor 327. Ring 330 may preferably feature adjusting capabilities allowing adjustment of its height above basin floor 327. Such capabilities allow calibrating the degree of exposure of opening 349, thence regulating the rate of flow and eventually the amount of dispensable liquid released therefrom with each flush cycle.

For example, extended conduit 335 may comprise an externally threaded portion 329 compatibly receivable by rotary movement relative to, and within an internally threaded ring 330 encircling threaded portion 329. In order to provide for fine tuning capabilities of the amount of liquid discharged each flush cycle, threaded end 329 and sleeve 331 preferably comprise, in registration, relatively fine threading allowing fine adjustment of threaded end 329 within ring 31. An alternate flow calibration control may be provided by an externally threaded end of conduit 335 that is compatibly receivable by rotary movement relative to and within an internally threaded upstanding apertured sleeve 331. Sleeve 331 is attached to basin 23 and encircles threaded end 329', save its cut out aperture 349. The operation of such structure is corresponding to what has been explained above.

Basin 323 comprises two conduits—a short conduit 339 with a closed bottom, and a long conduit 343 extending through basin floor 327 and having its outlet mouth 347 below basin floor 327. Conduits 339 and 343 may be drilled in a solid portion of basin 323 for ease of manufacture. An upper passage 341 connects the upper portions of conduits 339 and 343. A passage 363 connects the inner hollow parts of basin 323 to conduit 339. An enclosure and sealing element 357 completes the structure of basin 323. Element 357 has an L-shaped cross-section and comprises a roofing portion 359 and a side potion 361. Portion 359 conceals, and substantially makes watertight, the upper side of passages 341, and conduits 339 and 343. Portion 361 partially covers passage 363 but its main function is to hold portion 359 intact in place. Element 357 is held in place by inserting portion 361 through guiding rails 363 that are carved on walls 333.

While the invention has been described with respect to specific embodiments, it will be appreciated that many variations, modifications and other applications of the invention may be made.

With the foregoing description, it is believed apparent that the present invention enables the attainment of the objects initially set forth herein.

It should be understood, however, that the invention is not intended to be limited to the specifics of the illustrated embodiment, but rather is defined by the accompanying claims.

What is claimed is:

1. A passive dispenser for dosing and issuing a rationed amount of dispensable liquid into a cistern tank, from a volume of dispensable liquid stored in a container, the dispenser comprises:

(a) a discharge spout adapted to be in fluid communication with said container;

(b) a basin for receiving a rationed amount of dispensable liquid from said container, the basin comprises:

a. a basin floor, disposed below said spout;

b. upstanding basin walls extending upwardly from said basin floor, and extending above the discharge spout mouth;

c. whereby, when the basin is suspended and below the level of dispensable liquid in said container, and a predetermined level of dispensable liquid is disposed in said basin, an airlock is formed, preventing further liquid from evacuating said container;

(c) a siphon, comprising an inlet conduit having a siphon inlet disposed below said spout, and an outlet conduit having a siphon outlet disposed below said siphon inlet; said inlet conduit and outlet conduit being in fluid communication via a passage connecting therebetween, said passage disposed above the siphon inlet;

(d) wherein said siphon inlet being in fluid communication with said rationed amount of dispensable liquid disposed in the basin so that a vacuum created in said outlet conduit will siphon dispensable liquid from said basin, to be dispensed into the cistern when the cistern water is being flushed.

2. The passive dispenser of claim 1, wherein said basin walls are adapted to be immersed below the cistern water during quiescent periods.

3. The passive dispenser of claim 1 wherein said dispensable liquid comprises additives selected from a group consisting of a disinfectant, a detergent, a cleaner, a stain inhibitor, a bleach, a dye, a colorant, a fragrance, a perfume, a deodorant, or a mixture of two or more thereof.

4. A passive dispenser as in claim 1, wherein the dispenser is having the capability of varying the amount of dispensable liquid added to the cistern water.

5. A passive dispenser as in claim 4, wherein said discharge spout is adjustably movable to modify the distance between said spout discharge mouth and said basin floor, for varying the metered amount by varying the level of dispensable level dispensed in the basin.

6. A passive dispenser as in claim 1, wherein said basin further comprises discharge control means for providing restrained discharge of dispensable liquid from said discharge spout, said discharge spout comprises an externally threaded end compatibly receivable within an internally threaded upstanding sleeve attached to said basin and encircling said threaded end, said sleeve comprises at least one aperture or cut-out area, the extent of exposure of which is defined by the vertical adjustment of said threaded end within said sleeve.

7. A passive dispenser as in claim 1 further comprising discharge control means for providing restrained discharge of dispensable liquid from said discharge spout.

8. An passive dispenser as in claim 1, wherein said basin further comprises a surface tension moderator in the form of an upright projecting from said basin floor and overlappingly penetrating the mouth of said discharge spout.

9. A passive dispenser as in claim 1, further comprising a surface tension moderator in the form of ribs mounted on the mouth of said discharge spout.

10. A passive dispenser as in claim 1 further comprising a hanger for attaching said dispenser to a cistern.

11. The passive dispenser of claim 10 wherein said dispenser is adapted to cooperate with said hanger to allow adjustable positioning of at least the basin within the cistern.

12. The passive dispenser as in claim 1, wherein said discharge spout is integral to said container.

13. The passive dispenser as in claim 1, wherein said discharge spout is directed downwardly.

14. The passive dispenser of claim 1, further comprising an intermediate conduit connecting said spout with said container.

15. A passive dispenser for dosing and issuing a rationed amount of dispensable liquid having specific density heavier than water, into a cistern tank, the dispenser comprises:

(a) a inverted a container in which a volume of dispensable liquid is stored, said container coupled to a discharge spout;

(b) a basin adjustably disposed below said discharge spout for receiving a rationed amount of dispensable liquid from said container, the basin comprises:

a. a basin floor, adjacently disposed below said spout;

b. upstanding basin walls extending upwardly from said basin floor, and extending above the discharge spout mouth;

c. whereby, when the basin is suspended below the level of dispensable liquid in said container, and a predetermined level of dispensable liquid is disposed in said basin, an airlock is formed, preventing further liquid from evacuating said container;

(c) a siphon, comprising an inlet conduit having a siphon inlet disposed below said spout, and an outlet conduit extending through the basin floor and having a siphon outlet disposed below said siphon inlet; said inlet conduit and outlet conduit being in fluid communication via a passage connecting therebetween, said passage disposed above the siphon inlet;

wherein said siphon inlet being in fluid communication with said rationed amount of dispensable liquid disposed in the basin whereby a vacuum created in said outlet conduit will siphon dispensable liquid from said basin, to be dispensed into the cistern.

16. The passive dispenser of claim 15, wherein said basin further comprises discharge control means for providing restrained discharge of dispensable liquid from said discharge spout, said discharge spout comprises an externally threaded end compatibly receivable within an internally threaded upstanding sleeve attached to said basin and encircling said threaded end, said sleeve comprises at least one aperture or cut-out area, the extent of exposure of which is defined by the vertical adjustment of said threaded end within said sleeve.

17. A passive dispenser as in claim 15, wherein said basin further comprises a surface tension moderator in the form of an upright projecting from said basin floor and overlappingly penetrating the mouth of said discharge spout.

18. A passive dispenser as in claim 15, wherein said siphon inlet and said basin are disposed within a cylinder or a portion thereof.

19. The passive dispenser of claim 18, wherein said discharge spout is arranged substantially coaxial to said cylinder, and wherein said basin extends nearer the periphery of said cylinder.

20. A passive dispenser for dosing and issuing a metered amount of dispensable liquid having specific density heavier than water, into a cistern tank, the dispenser comprises:

(a) an inverted container in which a volume of dispensable liquid is stored, said container having a downwardly directed discharge spout positioned on said container below the dispensable liquid level within said container, said spout comprising an externally threaded end;

(b) a basin adjustably disposed below said discharge spout for receiving a rationed amount of dispensable liquid from said container, the basin comprises:

a. a basin floor; adjustably disposed below said spout;

b. upstanding basin walls extending upwardly from said basin floor, and constructed to extend above the level of said rationed amount of dispensable liquid when said liquid is disposed in said basin;

c. an internally threaded upstanding sleeve attached to said basin and adapted to encircle said threaded end, said sleeve comprises at least one aperture or cut-out area, the extent of exposure of which is defined by the vertical adjustment of said threaded end within said sleeve;

d. whereby, when the basin is suspended below the level of dispensable liquid in said container, and at least a rationed amount of dispensable liquid is disposed in said basin, an airlock is formed, preventing further liquid from evacuating said container;

(c) a siphon, comprising a short inlet conduit having a siphon inlet in its lower end, and a longer outlet conduit extending through the basin floor and having a siphon outlet below said basin floor; said inlet conduit and outlet conduit being in fluid communication via a fluid passage connecting therebetween, said fluid passage disposed above the siphon inlet;

(d) wherein said siphon inlet being in fluid communication with said rationed amount of dispensable liquid disposed in the basin whereby a vacuum created in said outlet conduit will siphon dispensable liquid from said basin, to be dispensed into the cistern.

21. The passive dispenser of claim 20 further comprising a surface tension moderator in the form of an upright projecting from said basin floor and overlappingly penetrating the mouth of said discharge spout.

22. The passive dispenser of claim 20 wherein said dispensable liquid comprises additives selected from a group consisting of a disinfectant, a detergent, a cleaner, a stain inhibitor, a bleach, a dye, a colorant, a fragrance, a perfume, a deodorant, or a mixture of two or more thereof.

23. The passive dispenser of claim 20 further comprising a hanger for attaching said dispenser to the cistern wall.

24. The passive dispenser of claim 20 wherein said basin further comprises a passage and a side portion, partially blocking said passage, and wherein said partially blocked passage comprises said siphon inlet.

25. A passive dispenser as in claim 20, wherein said siphon inlet and said basin are disposed within a cylinder or a portion thereof.

26. The passive dispenser of claim 20, wherein said discharge spout is arranged substantially coaxial to said cylinder, and wherein said basin further extends nearer the periphery of said cylinder, or a portion thereof.

27. A passive dispenser as in claim 20, wherein said siphon inlet and said basin are disposed within a cylinder or a portion thereof.

28. The passive dispenser of claim 27, wherein said discharge spout is arranged substantially coaxial to said cylinder, and wherein said basin further extends nearer the periphery of said cylinder, or a portion thereof.

* * * * *